US008863637B2

(12) United States Patent
Hall

(10) Patent No.: US 8,863,637 B2
(45) Date of Patent: Oct. 21, 2014

(54) ADJUSTABLE GAS CYCLIC REGULATOR FOR AN AUTOLOADING FIREARM

(71) Applicant: Corby Hall, New Braunfels, TX (US)

(72) Inventor: Corby Hall, New Braunfels, TX (US)

(73) Assignee: Corby Hall, Henderson, TX (US)

( * ) Notice: Subject to any disclaimer, the term of this patent is extended or adjusted under 35 U.S.C. 154(b) by 0 days.

(21) Appl. No.: 13/926,304

(22) Filed: Jun. 25, 2013

(65) Prior Publication Data

US 2014/0076143 A1 Mar. 20, 2014

Related U.S. Application Data

(63) Continuation-in-part of application No. 13/538,335, filed on Jun. 29, 2012, now abandoned.

(51) Int. Cl.
*F41A 19/02* (2006.01)
*F41A 19/03* (2006.01)
*F41A 5/28* (2006.01)

(52) U.S. Cl.
CPC .. *F41A 19/03* (2013.01); *F41A 5/28* (2013.01)
USPC ..... 89/129.01; 89/193

(58) Field of Classification Search
USPC ..... 89/129.01, 129.02, 130, 131, 132, 89/191.01, 191.02, 192, 193; 251/121, 251/122; 137/614.17, 614.18
See application file for complete search history.

(56) References Cited

U.S. PATENT DOCUMENTS

| | | | | | |
|---|---|---|---|---|---|
| 804,986 | A * | 11/1905 | Stamm | 89/129.01 |
| 2,003,066 | A * | 5/1935 | Brondby | 89/193 |
| 2,340,293 | A * | 2/1944 | Balleisen | 138/45 |
| 2,715,858 | A * | 8/1955 | Hoppert | 89/193 |
| 2,791,944 | A * | 5/1957 | Harvey | 89/193 |
| 3,690,219 | A * | 9/1972 | Muhlemann et al. | 89/193 |
| 4,244,273 | A * | 1/1981 | Langendorfer et al. | 89/193 |
| 4,503,632 | A * | 3/1985 | Cuevas | 42/1.06 |
| 5,272,956 | A * | 12/1993 | Hudson | 89/128 |
| 8,109,196 | B1 * | 2/2012 | Spence | 89/193 |
| 8,261,653 | B2 * | 9/2012 | Crommett | 89/193 |

* cited by examiner

*Primary Examiner* — Gabriel Klein

(57) ABSTRACT

The invention includes a gas valve having an annular body with an inner surface defining a gas chamber and first and second annular end surfaces defining first and second openings of said gas chamber, the gas valve further having outer surface and at least one gas channel extending between the inner surface and the outer surface providing a gas communication path from the outer surface to the gas chamber, wherein said at least one gas channel is orientated to direct fluid egressing from the channel into the chamber along the inner surface. The invention further includes a regulator occupying a portion of the chamber to define a chamber operating volume and flowrate, the regulator having a at least one outer diameter corresponding to an inner diameter of the passage to substantially inhibit gas flow from passing through the second opening.

11 Claims, 10 Drawing Sheets

ADJUSTABLE GAS CYCLIC REGULATOR FOR AN AUTOLOADING FIREARM

CROSS-REFERENCES TO RELATED APPLICATIONS

This is a continuation-in-part application claiming the benefit of the filing date of U.S. application Ser. No. 13/538,335, filed Jun. 29, 2012, which is incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention relates to autoloading firearms. More specifically, the invention is an apparatus for tuning the gas flow rate and/or timing of an autoloading firearm for various operating conditions.

2. Description of the Related Art

In the field of autoloading firearms, adjustable gas blocks provide means for compensating for regulated gas flow attributable to the use of silencers and various types of loads of ammunition. It is known, for example, that the addition of more gas into the operating systems increases the potential for failure of the autoloading mechanism. Particularly with high-precision autoloading firearms, the ability to fine tune the gas flow characteristics becomes even more important, as even minor differences between ammunition can affect the efficiency of the operation of the autoloading mechanisms.

One patent that shows a system of adjusting gas flow characteristics is U.S. Pat. No. 7,856,917, issued Dec. 28, 2010 to Noveske, which is incorporated by reference herein. Noveske discloses an improved switchblock for use in autoloading firearms that facilitates user adjustment of the gas output. Noting that other designs, such as the ArmaLite AR10 gas block, offer the user the ability to regulate gas flow by toggling a screw between only two positions, Noveske offers three such positions of adjustment: a standard gas flow optimized for a firearm, a reduced gas flow optimized for the firearm when used with a suppressor, and a no-flow position which completely shuts off gas flow.

Other manufacturers offer products that provide the ability to "micro" tune gas flow. For example, Spike Tactical LLC of Apopka, Fla. and JP Enterprises, Inc. of Hug, Minn. offer an adjustable gas block that relies moving a set screw into and out of the volume of the gas block or gas tube in a direction other than parallel to the longitudinal axis of the volume. Spike Tactical's product is sold under the tradename SUGB130. JP Enterprises's product is sold under the tradename JP Adjustable Gas System.

While Noveske, ArmaLite, Spike Tactical, and JP Enterprises represent improvements over other systems that do not provide a mechanism for adjusting gas flow characteristics, Noveske does not provide fine, indiscrete tuning of such characteristics. And even when providing adjustable positions for regulating, existing systems introduce gas into the gas chamber in a highly turbulent manner that directs the gas directly toward a surface of the gas chamber. This causes the gas to immediately lose significant amount energy while turning ninety-degrees toward the piston assembly, and negatively affects the gas-cyclic efficiency and overall performance of the autoloading firearm.

For high-precision firearms, the pressure and volume flow-rate required to actuate the piston, and thus cause reloading of the firearm, must fall within a given range. When using different bullet types, weights, and load charges, the pressures created by the bullet discharge may fall outside that range, effectively meaning that the firearm will not properly cycle with all loads. Systems such as Noveske, however, do not provide the user with the ability for tuning of the auto-loading mechanism of such high-precision firearms.

BRIEF SUMMARY OF THE INVENTION

The present invention allows virtually unlimited tuning of the gas flow rate for different operating conditions, such as suppressor usage and ammunition type. The invention acts as a delay mechanism by inducing a swirl flow pattern, and/or by providing a means of adjusting the operating volume within a gas valve, thus extending (or otherwise regulating) the gas front's distance of travel within the gas chamber. The delay may be desirable for proper cyclic timing of autoloading firearms, particularly those using a piston-pushrod mechanism. The present invention also substantially reduces gas-flow turbulences associated with the instant ninety-degree transition, thus increasing gas-cyclic efficiency, reducing felt-recoil, and improving accuracy and overall performance of the autoloading firearm.

The invention includes a gas valve having an annular body with an inner surface defining a gas chamber and first and second annular end surfaces defining first and second openings of said gas chamber. The gas valve has an outer surface and at least one gas channel extending between the inner surface and the outer surface providing a gas communication path from the outer surface to the gas chamber. The gas channel is orientated to direct fluid egressing from the channel into the chamber along the inner surface. The invention further includes a regulator occupying a portion of the chamber to define a chamber operating volume, the regulator having at least one outer diameter corresponding to an inner diameter of the passage to substantially inhibit gas flow from the from the chamber therebetween.

DETAILED DESCRIPTION OF EMBODIMENTS OF THE INVENTION

Figure 1:
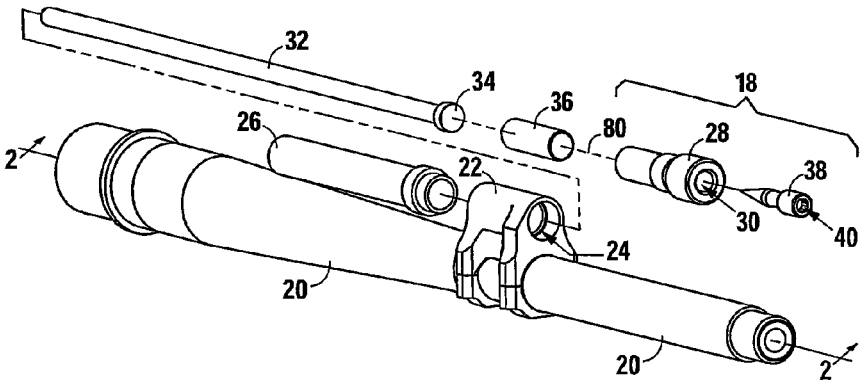
FIG. 1 is an assembly view of an embodiment of the present invention in use with components of an autoloading firearm.

FIG. 1 shows an embodiment 18 of the present invention in connection with components of an autoloading firearm having a barrel 20. The autoloading components include a gas block 22 attached around the barrel 20 that defines a generally cylindrical interior 24, and a gas tube 26 coupled to the gas block 22. A piston rod 32 has a head 34 movable within the gas tube 26. A piston member 36 is also positioned within the gas tube 26 adjacent the piston rod 32 and the gas valve 28. The gas tube 26 is a generally cylindrical hollow body having a partially closed end allowing the piston rod 32 and piston member 36 to cycle therewithin, with the opposing end of the piston rod 32 connected to the remainder of the autoloading mechanism (not shown) to eject the spent casing and load a new round.

The embodiment 18 includes a gas valve 28 that defines a generally cylindrical gas chamber 30. The gas valve 28 is positioned within the interior 24 of the gas block 22. The gas valve 28 is longitudinally fixed but rotatable around an axis 80 relative to the gas block 22. The gas chamber 30 and interior 24 of the gas block 22 are coaxially aligned about the axis 80.

The embodiment further includes a regulator 38 that is at least partially positionable in the gas chamber 30 through an end of the gas valve 28. A drive slot 40 is formed in one end of the regulator 38 for receiving a driving tool (not shown).

Figure 2:
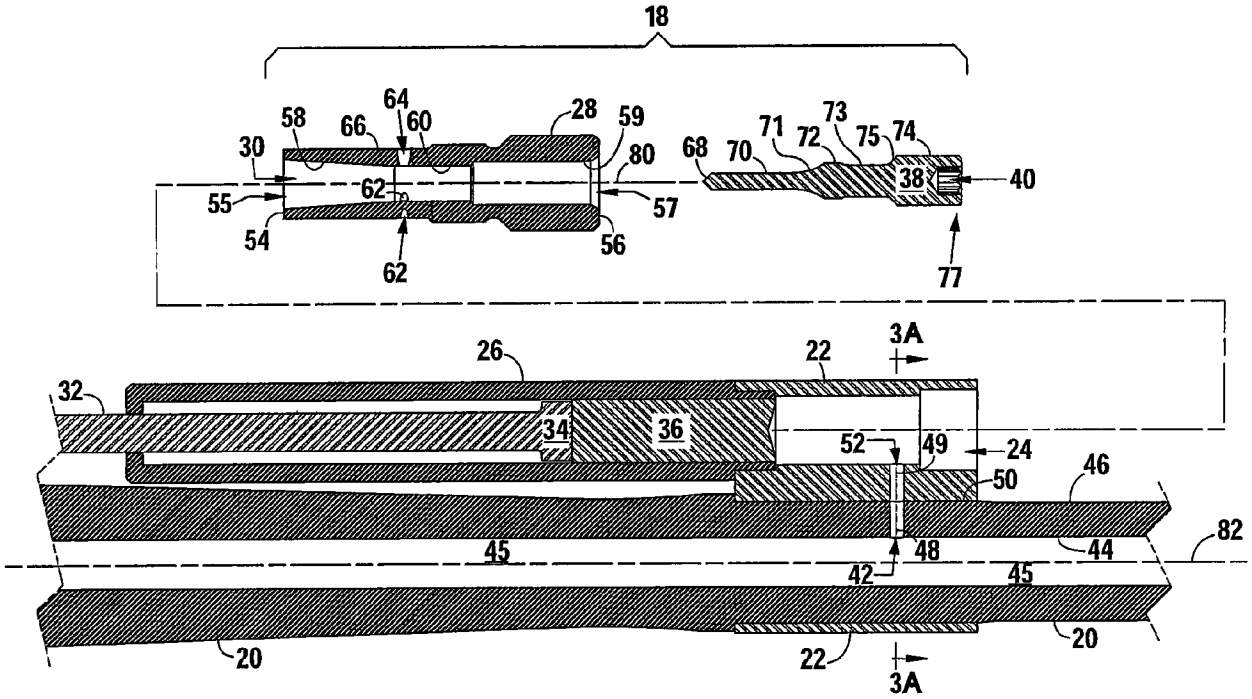
FIG. 2 is a side sectional view through a plane intersecting line 2-2 of FIG. 1.

Referring specifically to FIG. 2, the barrel 20 has a cylindrical inner surface 44 that defined a barrel interior 45 about a barrel axis 82, and an outer surface 46. A barrel channel 42 provides a gas pathway between the inner and outer surfaces 44, 46, with the axis 48 of the barrel channel 42 intersecting, and extending perpendicularly to, the barrel axis 82.

The gas block 22 has an outer surface 50 in contact with the outer surface 46 of the barrel 20. A block channel 52 provides a gas pathway between the outer surface 50 of the gas block 22 and the passage 24. An axis 49 of the block channel 52 is aligned with the barrel channel 42.

The gas valve 28 is a generally annular body positionable in the interior 24 of the gas block 22. The gas valve 28 has opposing first and second annular surfaces 54, 56 defining first and second openings 55, 57, respectively, to the chamber 30. The inner surfaces defining the chamber include a partially conical surface 58 adjacent to the first opening 55 and positioned adjacent to a cylindrical intermediate surface 60. A generally cylindrical threaded surface 59 is positioned between the intermediate surface 60 and the second opening 57. First and second gas channels 62, 64 extend from an outer surface 66 of the gas valve 22 to the cylindrical inner surface 60 to provide a gas pathway from the exterior of the gas valve 28 to the chamber 30.

The regulator 38 of this embodiment is an elongate solid body that comprises conical end surface 68. A first cylindrical surface 70 is proximal to the conical end surface 68 and adjacent to a second cylindrical surface 72, with the first and second cylindrical surfaces 70, 72 joined by a concave surface 71. The regulator 28 has a slotted end having a threaded surface 74 connected to the second cylindrical surface 72 with a second concave surface 75. The threaded surface 74 is engagable with the threaded surface 59 of the gas valve to allow altering of the longitudinal position of the regulator 38 therein. The driver slot 40 is formed in the second end 77 of the regulator 38. A gas communication path is established between the barrel interior 45 and the chamber 30 through the barrel channel 42, block channel 52, and the first channel 62.

Figure 3A:
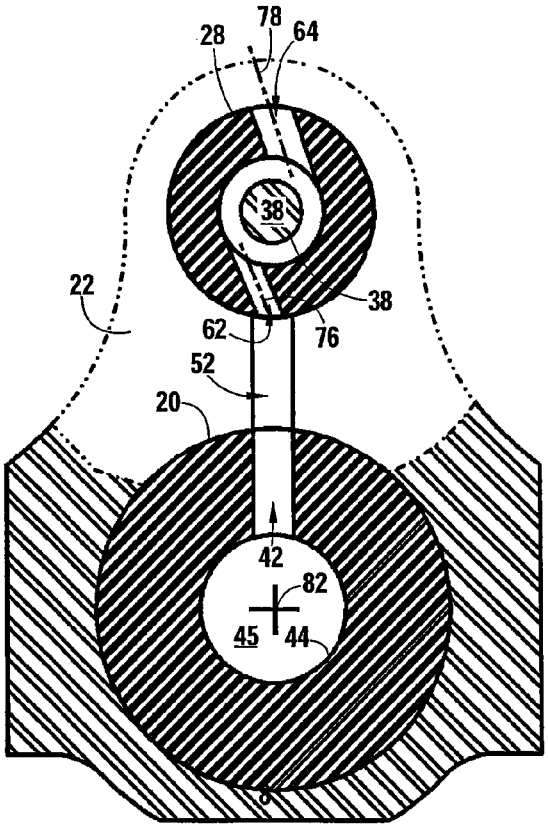
FIG. 3A is a sectional view through line 3-3 of FIG. 2.

Referring to FIG. 3A, the gas channels 62, 64, which are preferably cylindrical, have center axes 76, 78 that are angled relative to, and do not intersect with, the axis 80 of the gas valve 28. In that regard, the axes 76, 78 of the gas channels 62, 64 of this embodiment are substantially parallel to one another.

Figure 3B:
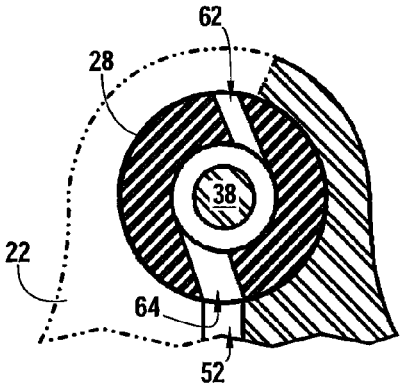
FIG. 3B is a sectional view of FIG. 3A with the regulator in an alternate configuration.

As shown in FIG. 3B, the gas valve 28 is rotatable within the gas block 22 so that either of the first or second gas channels 62, 64 may be aligned with the block channel 52 to receive gas flow therefrom. When one of the channels is aligned with the block channel 52, the other channel is misaligned with the block channel 52. Although the described embodiment comprises two gas channels 62, 64 having opposing openings, other embodiments may include any number of such gas channels alignable with the block channel 52.

Figure 4:
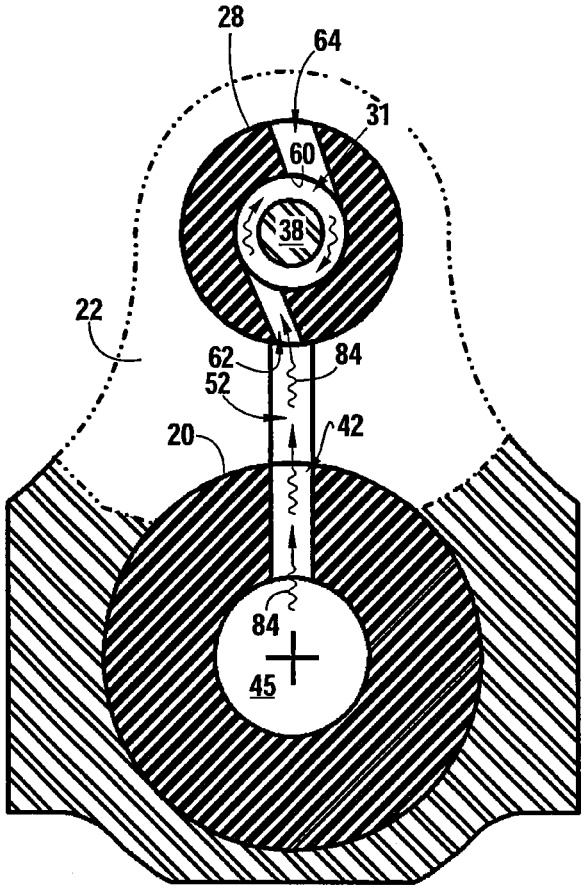
FIG. 4 shows operation of the described embodiment.

Operation of the embodiment is initially described with reference to FIG. 4. Following discharge of the firearm, a bullet moves through the barrel interior 45, causing a pressure increase in the barrel 20 from the expanding gas 84 associated with discharge. The expanding gas 84 moves through the barrel channel 42, block channel 52, and into the first channel 62 of the gas valve 28, where gas flow is introduced into the gas chamber 30 toward the intermediate surface 60. The presence of the regulator 38 within the chamber 30 defines an annular space 31 between a surface 70 of the regulator 38 and the inner surface 60, which causes the introduced gas flow to move around the annular space 31, thereby increasing the delay (when compared to generally traditional systems) before the increasing pressure operates on the piston member 36 to move the piston rod 32 away from the gas block 22 (see FIG. 2), and causing the autoloading firearm to cycle, eject, and load another ammunition cartridge.

Referring to FIG. 2, the timing of the cyclic action is at least partially a function of the operating volume of the gas chamber 30, where operating volume is the volume into which the gas can expand against the piston member 36 before leaving the chamber 30 through the first opening 55, and the path the gas travels to cause a pressure increased at the piston member 36. Thus, by introducing the gas toward the intermediate surface 60 of the gas valve 28, the gas 84 tends to move around the annular space 31. Introduction of the gas 84 into the gas chamber 30 in this manner reduces gas-flow turbulences compared to directing the gas directly toward the axis 80 and opposing side of the gas chamber 30, thus increasing gas-cyclic efficiency and overall performance of the autoloading firearm.

Figure 5A:
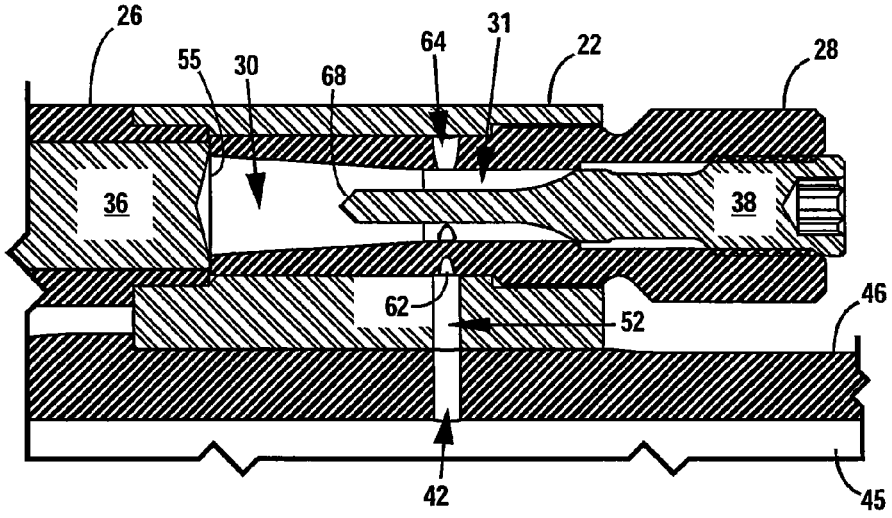
FIGS. 5A and 5B show possible positions of the regulator within the chamber of the gas valve.
Figure 5B:
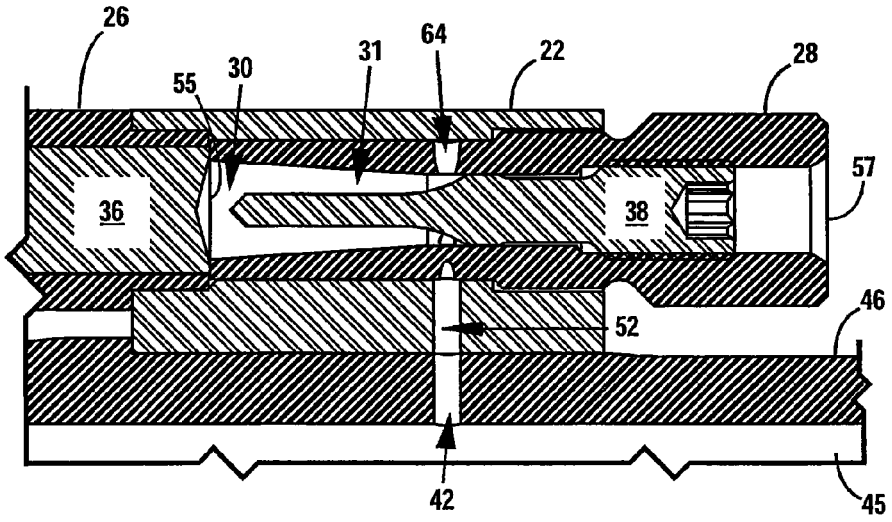

As shown in FIGS. 5A-5B, the regulator 38 is insertable into the gas chamber 30 at various positions to alter the size of the operating volume. FIG. 5A shows the regulator wherein the conical end surface 68 is at a first distance from the first opening 55. FIG. 5B shows the regulator wherein the conical end surface 68 is a second distance from the first opening 55, wherein the second distances is less than the first distance. The regulator may be moved between the positions shown in FIGS. 5A and 5B with a driving tool in conjunction with the drive slot 40 and the threaded surfaces 59, 74. The operating volume of the chamber 30 is smaller in the configuration shown in FIG. 5B than FIG. 5A. In either case, engagement of the regulator 38 with the gas valve 28 at least substantially prevents gas flow from passing through the second opening 57.

Figure 6:
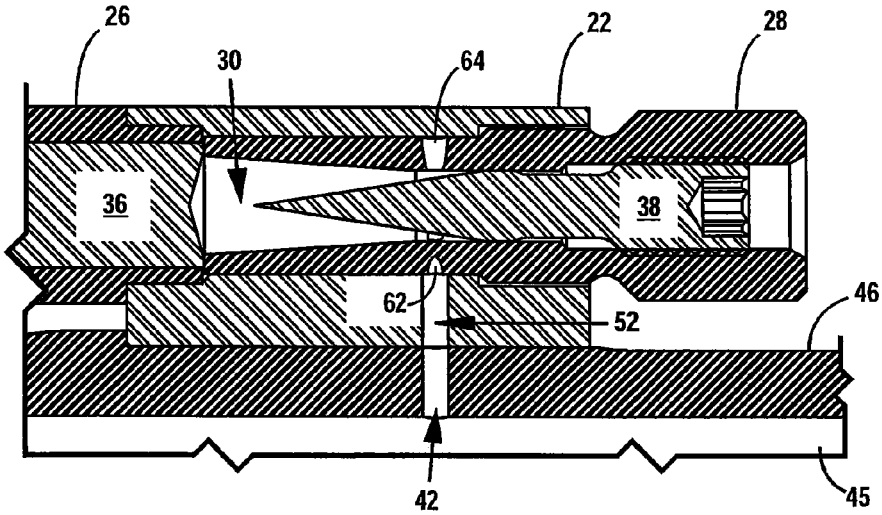
FIG. 6 shows an alternative embodiment of the regulator that includes a tapered regulator.

While the preferred embodiment shows a specifically needle-shaped regulator 38 having a partially conical surface adjacent to a cylindrical surface, other embodiments incorporate any regulator shape that substantially inhibits gas from egressing from the gas valve 28 through the second opening 57 and that does not inhibit swirling movement of the gas within the chamber 30. For example, FIG. 6 shows an alternative embodiment in which the regulator 38 has a tapered shaped.

Figure 7:
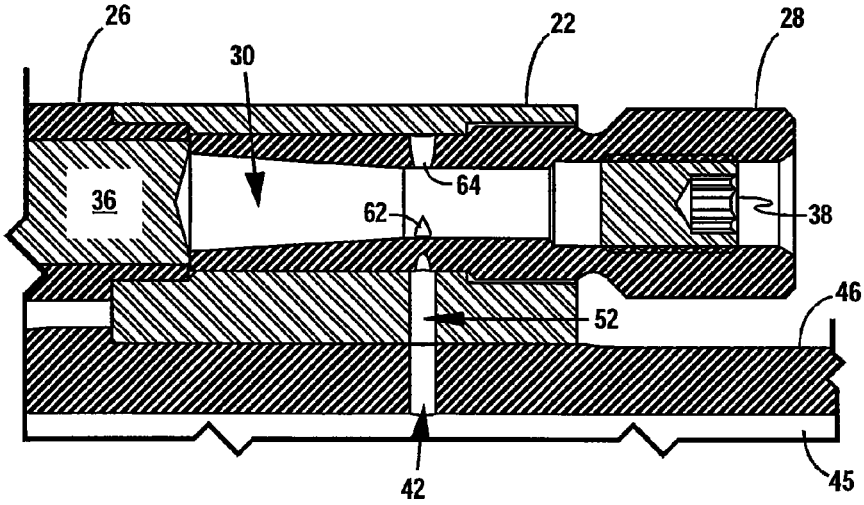
FIG. 7 shows an alternative embodiment of the regulator that is a cylindrical body.

FIG. 7 shows another alternative embodiment in which the regulator 38 is a cylindrical body. Introduction of the gas in the same manner as described with reference to FIG. 4 causes a swirling action, but the swirling action will dissipate more quickly than with the embodiments shown in FIGS. 5A and 6 because of the absence of the annular space 31.

Figure 8:
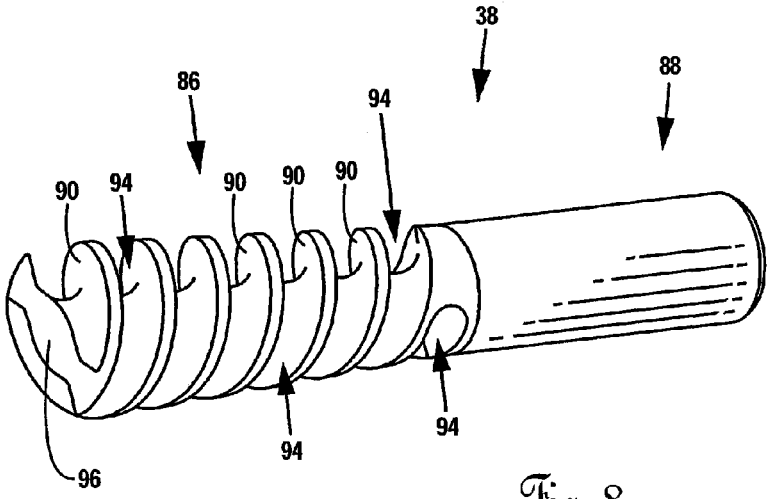
FIG. 8 shows an alternative embodiment of the regulator that includes a helical section joined to a cylindrical section, with the helical section defining a helical communication path.

FIG. 8 shows yet another alternative embodiment in which the regulator 38 comprises a helical section 86 adjacent to a cylindrical body section 88. The helical section 86 comprises first and second helical surfaces 90, 92 that form a helical communication path 94. The helical section terminates in a free end 96.

Figure 9:
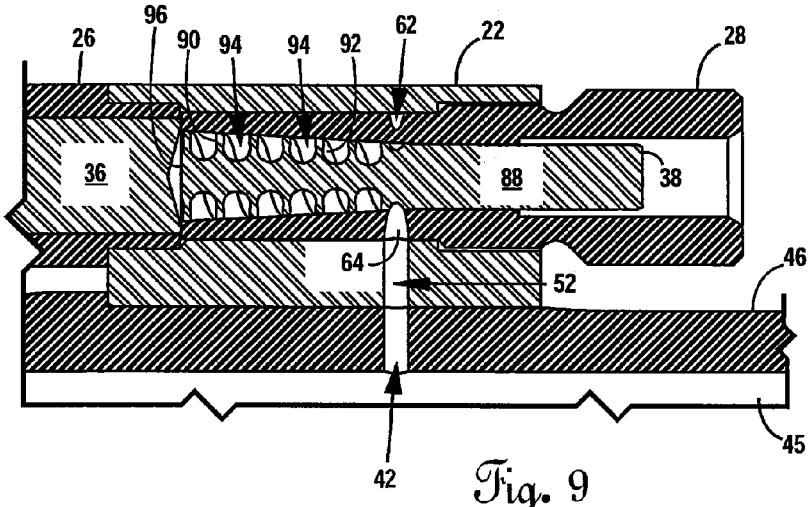
FIG. 9 shows the embodiment of the regulator shown in FIG. 8 in use with the gas block and gas valve described with reference to FIGS. 1-4.

FIG. 9 shows the regulator embodiment described with reference to FIG. 8 in use with the gas block 22 and gas valve 28 previously described. The gas valve 28 is configured to align the second gas channel 64 with the block channel 42. The helical communication path 94 extends between the opening of the second gas channel 64 to the free end 96 of the helical section 86. The distances from the center of the chamber 30 to the edge of the first and second helical surfaces 90, 92 corresponds to the inner diameter of the partially conical surface 58, such that gas flow other than through the helical communication path 94 is inhibited. The pitch and cross section of the spiral defined by the first and second helical surfaces 90, 92 can be changed to accommodate desired operating characteristics.

Figure 10:
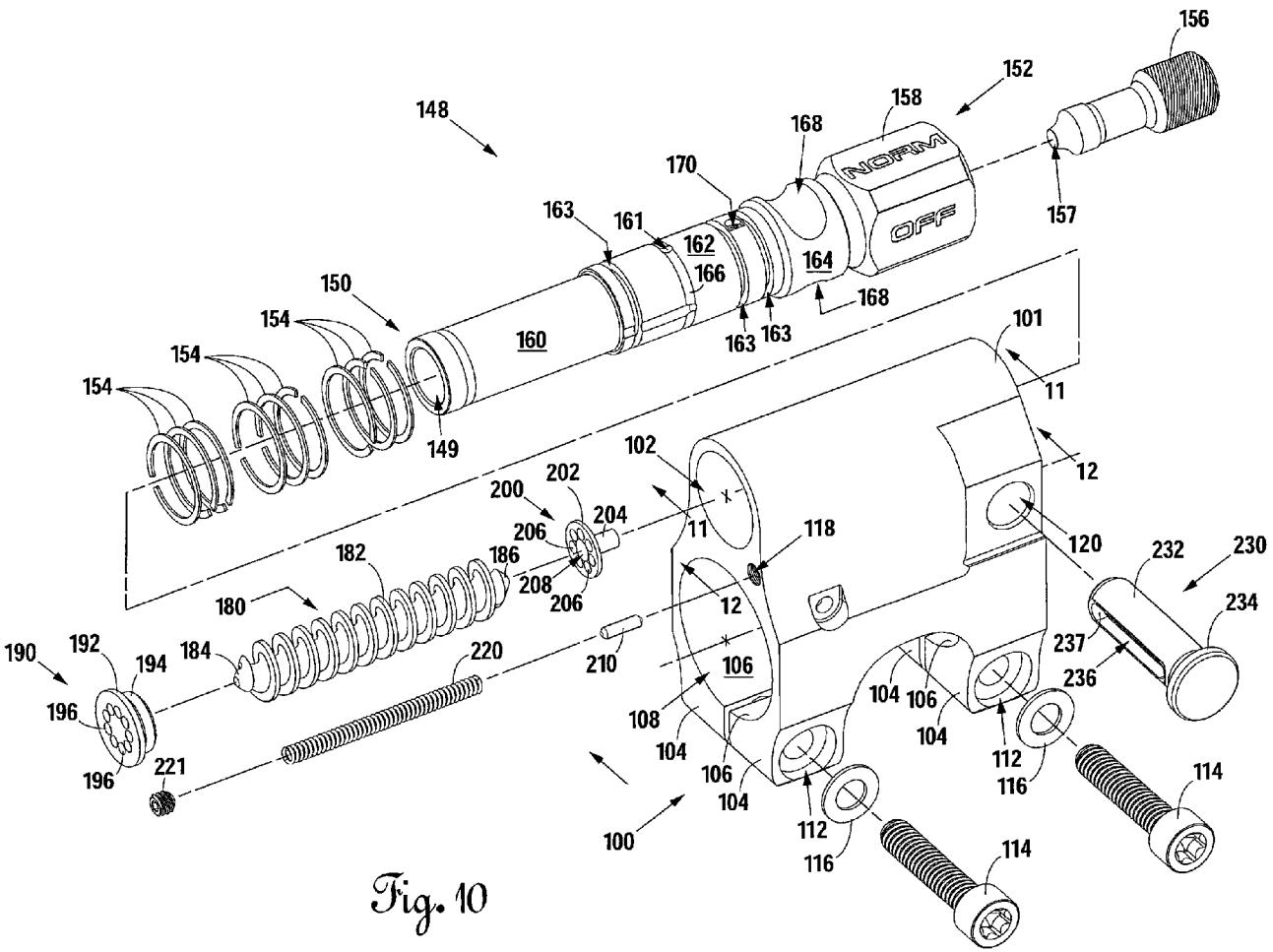
FIG. 10 shows an assembly view of yet another alternative embodiment of the invention.

FIGS. 10-13 show yet another embodiment of the present invention. Referring first to FIG. 10, the embodiment includes a gas block 100 with a block body 101 defining a generally cylindrical main bore 102. A second bore 118 extends longitudinally through the body 101 parallel to the main bore 102, and intersects a third bore 120 that extends laterally through the body 101 perpendicularly to the main bore 102 and second bore 118.

The gas block 100 has opposing pairs of fingers 104 extending away from body 101. Each finger 104 has a partially cylindrical surface 106 that partially defines a generally cylindrical barrel passage 108 for receiving the barrel of a firearm. Holes 112 for receiving bolts 114 extend laterally through each of the fingers 104, with holes 112 of opposing fingers 104 aligned to receive a single bolt 114. The gas block 100 may be fixed around the barrel by clamping the opposing fingers 104 together with the bolts 114 disposed through washers 116.

Figure 11:
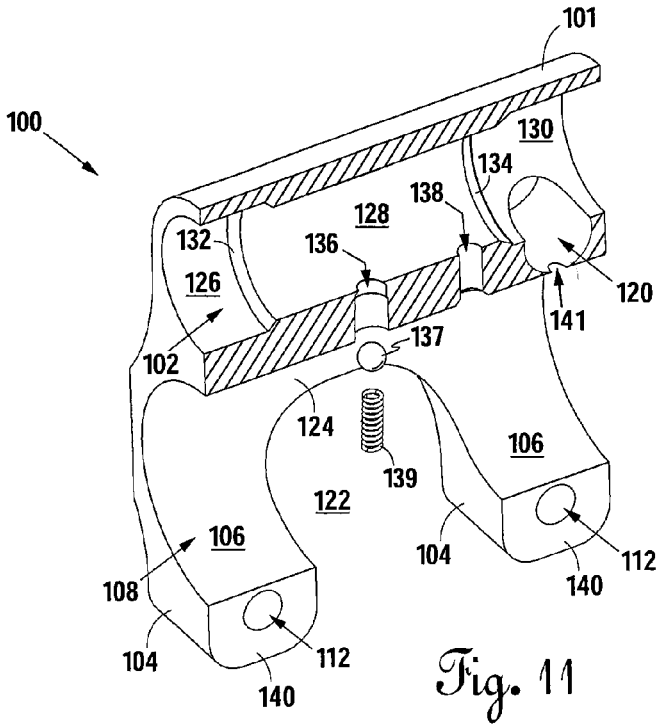
FIG. 11 is a sectional view of the gas block of this alternative embodiment through line 11-11 of FIG. 10.

Referring to FIG. 11, which shows aspects of the block 100 in greater detail, each of the fingers 104 terminates in a planar surface 140, with each terminal planar surface being spaced apart from a corresponding terminal planar surface of an opposing finger (not shown). The fingers 104 are separated by a lateral channel 122. Each finger 104 has a partially cylindrical surface 106 adjacent to an intermediate partially cylindrical surface 124 that together define one half of the passage 108. When clamped to a barrel, each terminal planar surface 140 contacts its corresponding terminal planar surface (not shown) to reduce the volume of the passage relative to the volume shown in FIG. 11 and fix the gas block 100 to the barrel through frictional engagement of the surfaces 106, 124 with the barrel.

Still referring to FIG. 11, the main bore 102 is defined by a number of cylindrical and partially-conical surfaces. More specifically, the main bore 102 is defined by a first cylindrical surface 126, a second cylindrical surface 128, and a third cylindrical surface 130. A first partially conical surface 132 is adjacent to and longitudinally between the first and second cylindrical surfaces 126, 128. A second partially conical surface 134 is adjacent to and longitudinally between the second and third cylindrical surfaces 128, 130. Each of these surfaces are axially aligned with one another.

Three passages are formed between the main bore 102 and the barrel passage 108. A first generally cylindrical volume 136 and a second generally cylindrical volume 138 extend between the barrel passage 108 and the main bore 102 through openings in the second cylindrical surface 128. The first volume 136 is sized to receive a corresponding ball 137 and spring 139, and has a tapered end proximal to the second cylindrical surface that restricts the ball 137 from moving into the main bore 102. An opening 141 extends between the lateral channel 120 and the barrel passage 108.

Figure 12:
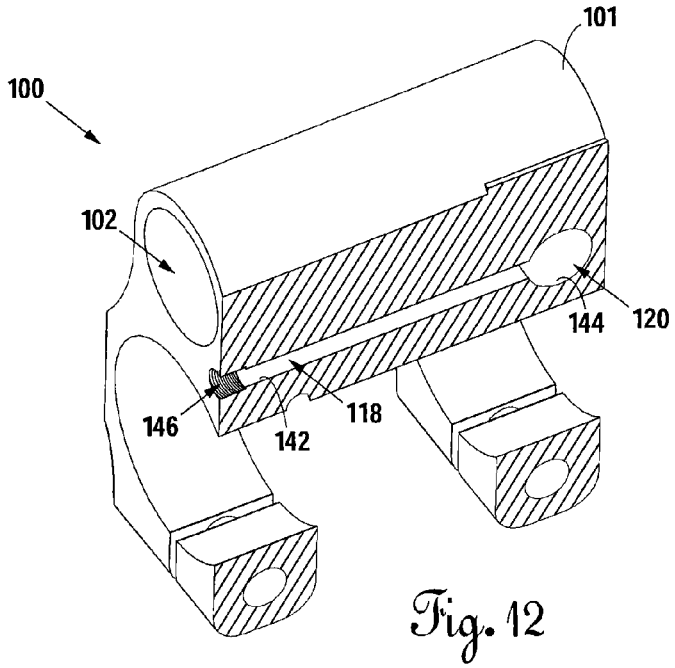
FIG. 12 is a sectional view of the gas block of this alternative embodiment through line 12-12 of FIG. 10.

Referring to FIG. 12, the second bore 118 is defined by a cylindrical surface 142 and the lateral channel 120 is defined by a partially cylindrical surface 144. One end 146 of the cylindrical channel 118 has inner threads.

Referring back to FIG. 10, the embodiment includes a tubular gas valve 148 having a first end 150 and second end 152. The valve 148 defines a generally cylindrical gas chamber 149 extending between the first and second ends 150, 152. The gas valve 148 is sized to fit a least partially through the main bore 102 of the gas block 100. The second end 152 has a threaded recess (not shown) for receiving a threaded adjustment screw 156.

The gas valve 148 includes a generally cubic grip 158 co-terminating with the second end 152. The valve 148 further includes a first cylindrical outer surface 160 adjacent to the first end 150, a second cylindrical outer surface, and a partially-cylindrical outer surface 164 defined by a third generally cylindrical surface 165. Opposing lateral grooves 168 are formed in the partially-cylindrical outer surface 164.

Three grooves 163 are formed in the second surface 160, with each groove 163 sized to receive a group of three split rings 154. A curved fourth groove 166 circumscribes the second surface 161. A first gas port 170 and an opposing second gas port (not shown) provide differently sized gas pathways between the surface 161 and the gas chamber 149.

The pitch and cross section of the surfaces of the helical body 180 can be changed to accommodate desired operating characteristics. The pitch and cross section are the primary determining factors of the gas delay (i.e., volume and travel distance), whereas the adjustment screw 156 is the primary influence on gas flowrate through the system. The helical body 180 can be removed and replace with another body having surfaces with different pitch and cross-section parameters to achieve the desired delay.

Gas flow through the chamber 149 is affected by a main regulator 180 positioned longitudinally between first and second auxiliary regulators 190, 200. The main regulator 180 has a helical body 182 with a generally conical first end 184 and a generally conical second end 186. The first auxiliary regulator 190 has a cylindrical cap 192 and a cylindrical body 194 extending therefrom. A plurality of cylindrical channels 196 extends longitudinally through the cap 192. The outer diameter of the cap 192 is larger than the inner diameter of the first end 150 of the gas valve 148. A conical recess (not shown) is formed in the body 194 opposite the cap 192.

The pitch and cross section of the surfaces of the helical body 180 can be changed to accommodate desired operating characteristics. The pitch and cross section are the primary determining factors of the gas delay (i.e., volume and travel distance), whereas the adjustment screw 156 is the primary influence on gas flowrate through the system. The helical body 180 can be removed and replace with another body having surfaces with different pitch and cross-section parameters to achieve the desired delay.

The second auxiliary regulator 200 has cylindrical cap 202 and a cylindrical body 204 extending therefrom. A plurality of cylindrical channels 206 extends longitudinally through the cap 202. The body 206 has an outer diameter sized to fit within the recess 157 of the adjustment screw 156. A conical recess 208 is formed in the cap 202 opposite the body 204 corresponding the size and shape of the second end 186 of the regulator 180.

Rotation of the valve 148 is generally inhibited by a generally cylindrical first pin 210 a first compression spring 220, and a slotted second pin 230. The first pin 200 and first spring 210 each have an outer diameter sized to fit in the second bore 118. A screw 221 has outer threads for engaging the inner threads at the end of the second bore 118 and retains the pin 210 and the spring 220 within the bore 118.

The second pin 230 has a cylindrical body 232 and a cap 234. The second pin body 232 has an outer diameter sized to closely fit within the third bore 120 and that corresponds to the curvature of the lateral grooves 168. The diameter of the cap 234 limits complete insertion of the second pin 230 into the third bore 120. A slot 236 having an end wall 237 is formed along the pin body 232 and sized to receiving the first pin 210 from the second bore 118. Because the screw 221 is fixed to the block 100, the spring exerts an expansive force on the free first pin 210 to urge the first pin toward the third bore 120 and into the slot 236.

Figure 13:
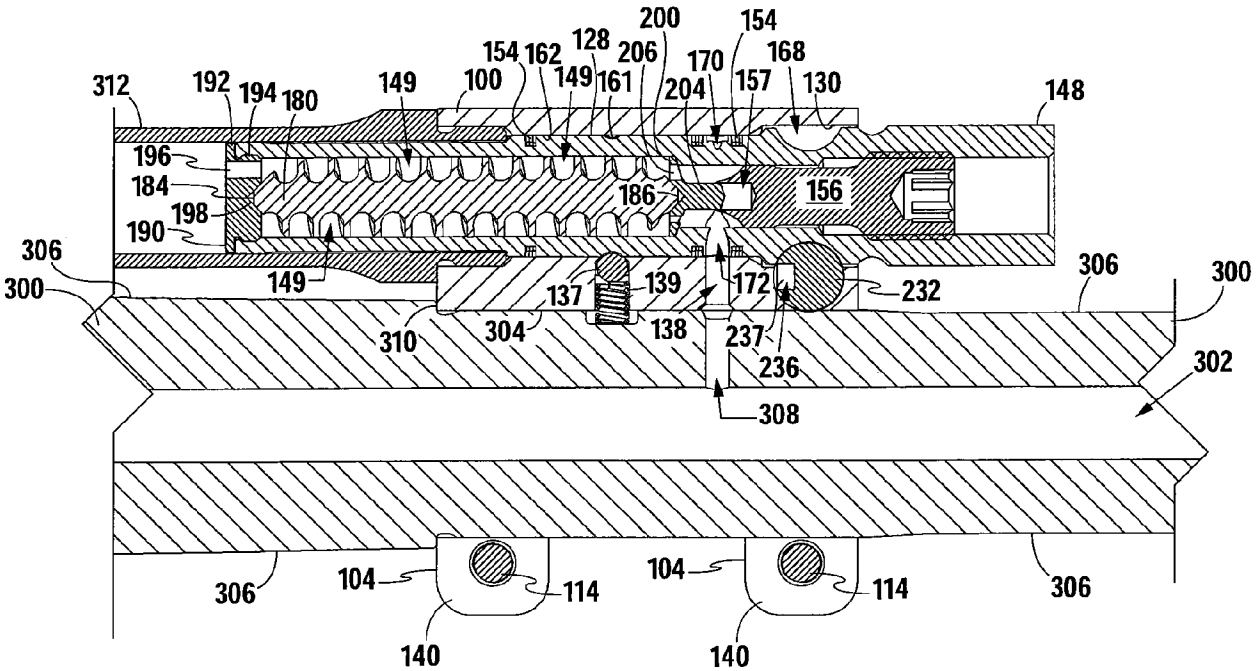
FIG. 13 is a side sectional view of the alternative embodiment shown in FIG. 10 mounted on the barrel of a firearm.

FIG. 13 shows this embodiment fixed to the barrel 300 of a firearm. The barrel defines a barrel interior 302 and a planar surface 304 composing part of the barrel's outer surface 306. A barrel channel 308 provides a fluid communication path between the barrel interior 302 and the outer surface 306.

The gas block 100 is fixed to the barrel 300 to prevent both longitudinal and rotational movement relative thereto. The pairs of opposing block fingers 104 are fastened to one another with bolts 114. The block 100 is adjacent to an annular shoulder 310 formed by the outer surface, which inhibits movement of the gas block 100 toward the chamber end of the barrel 300.

The gas valve 148 is positioned partially in the main bore 102, with the second surface 162 adjacent the second cylindrical surface 128 of the valve 148. Movement of the gas valve 148 relative to the gas block 100 is inhibited by the split rings 154, with each split ring 154 exerting a outward radial force against the second cylindrical surface 128.

The third surface 164 of the valve 148 is positioned in the volume defined by the third cylindrical surface 130 of the block 100. A portion of the first intermediate surface 160 is positioned within the volume defined by the first cylindrical surface 126 of the block 100. The entirety of the first intermediate section 160 and the first end 150 of the valve 148 occupies part of a cylindrical space defined by a gas tube 312, which is threaded to the gas block 100. The first auxiliary regulator 190 is fixed to the first end of the valve 148 with an interference fit.

The adjustment screw 156 is threaded to gas valve 148 and contacts the second auxiliary regulator 200. The regulator body 204 partially occupies the recess 157. The regulator 180 is longitudinally positioned between the first auxiliary regulator 190 and the second auxiliary regulator 200. The first end 184 of the regulator 180 is positioned in a conical recess 198 formed in the body of the first auxiliary regulator 190. The second end 186 of the regulator 180 is positioned in the recess 208 formed in the second auxiliary regulator 200.

As shown in FIG. 13, the second gas channel 172 is aligned with the block channel 138 to establish a fluid communication path between the barrel interior 302 and the interior of the gas tube 310. Following discharge of the firearm, a bullet moves through the barrel interior 302, causing a pressure increase in the barrel 300 from the expanding gas associated with discharge. The expanding gas moves through the barrel channel 308, block channel 138, and into the second channel 172, where gas flow is introduced into the gas chamber 149 between the cap 202 of the second auxiliary regulator 200 and the adjustment screw 156.

After introduction into the gas chamber 149, the gas travels through the channels 206 of the second auxiliary regulator 200 to the space occupied by the main regulator 180. The presence of the main regulator 180 within the chamber 149 defines a spiral path between the surfaces of the regulator 180 and the valve 148, which causes the introduced gas flow to move in a spiral manner around the regulator 138. When the gas reaches the first auxiliary regulator 190, gas moves through the channels 196 and operates on the piston member to move the piston rod (not shown) away from the gas block 100, thus causing the autoloading firearm to cycle, eject, and load another ammunition cartridge. Because the timing of the delay is a function of the effective volume of gas chamber 149, moving the adjustment screw 156 toward the regulator 180 decreases the effective volume within the chamber 140 and thus decreases delay relative to the configuration shown in FIG. 13.

Movement of the valve 148 relative to the block 100 is inhibited in two degrees of motion. The second pin body 232 occupies one of the grooves 168. Because the curvature of the body 232 corresponds and is sized to closely fit with the groove 168, occupying the groove 168 prevents rotation translational movement of the valve 148 within the main bore 102.

The valve 148, however, may be rotated within the main bore 102 to an alternate rotational position as follows. First, the second pin body 232 is removed from the occupied groove 168. Complete removal of the pin 232 is prevented by contact of the first pin 210 with the end 237 of the slot 236 formed in the second pin body 232. The first pin 210 is urged into the slot 236 by the compression spring (not shown). When the first pin 210 is so engaged, however, the second pin body 232 does not occupy the groove 168 and therefore does not inhibit rotational movement of the valve 148.

The valve 148 may then be rotated one-hundred eighty degrees to align the first channel 170 with the block channel 138. Alternatively, the valve 148 can be rotated to an "off" position, in which neither the first channel 170 nor the second channel 172 is aligned with the block channel 136, thus preventing expanding gas to flow through the valve to the gas tube 312.

In addition to an adjustable operating volume, this present invention provides for an adjustable flowrate of the gas as it moves through the gas chamber. So long as the regulator 38 (as shown in FIGS. 1-9) or adjustment screw 156 (as shown in FIGS. 10-13) does not intersect the path of gas at it enters the gas chamber, flowrate of the gas is unaltered even though the operating volume can change with a change in the position of the regulator 38 or screw 156). When the regulator 38 or screw 156, as applicable, intersects with gas path as it enters the chamber, gas flowrate is affected as well. As an example, in FIG. 7, the regulator 38 does not intersect the gas path. In each of the remaining figures, however, the regulator or screw intersects the gas path.

Rotation of the valve 148 is also impeded by the presence of the ball 137 in one of two opposing detents 161. The ball 137 is urged into a detent 161 by the second spring 139, although resistance caused by the ball 137, corresponding detent 161, and second spring 139 are easily overcome, and are intended to provide a tactile indication of when the valve 148 is correctly positioned to align either the first gas channel 170 or second gas channel 172 with the block channel 138. Also, while split rings 154 may minimally contact the valve 148, static friction resulting from any such contact, if any, is minimal, in part because the split rings 154 exert a radially outward force away from the valve 148.

The present invention is described in terms of preferred and other specifically-described embodiments. Those skilled in the art will recognize that alternative embodiments of such device can be used in carrying out the present invention. Other aspects and advantages of the present invention may be obtained from a study of this disclosure and the drawings, along with the appended claims.

I claim:

1. A gas valve assembly for use with an autoloading firearm, the assembly comprising:

a gas valve having an annular body around a longitudinal gas valve axis, said gas valve having an inner surface defining a gas chamber and first and second annular end surfaces defining first and second openings of said gas chamber, the gas valve further having an outer surface and at least one gas channel extending between the inner surface and the outer surface providing a gas communication path from the outer surface to the gas chamber, wherein said at least one gas channel has a gas channel axis;

a main regulator having a helical body, a generally-conical first end, and a generally-conical second end opposite the helical body from the first end, the main regulator occupying a portion of the chamber to define an operating volume, the main regulator having at least one outer diameter corresponding to an inner diameter of the gas chamber; and a first auxiliary regulator having a body, a conical surface forming a recess in the body, and a plurality of cylindrical surfaces defining channels through the cap in a direction parallel to said gas valve axis, wherein said conical surface is in contact with the first end of said main regulator.

2. The gas valve assembly of claim 1 wherein the gas channel axis does not intersect the longitudinal gas valve axis.

3. The gas valve assembly of claim 1 wherein the operating volume is adjustable by changing the position of the regulator relative to the gas valve.

4. The gas valve assembly of claim 1 wherein the flow rate is adjustable by changing the position of the regulator relative to the gas valve.

5. The gas valve assembly of claim 1 wherein the at least one gas channel comprises opposing first and second gas channels.

6. The gas valve assembly of claim 1 wherein the operating volume further comprises an annular space between a portion of the regulator and an inner surface of the gas chamber.

7. The gas valve assembly of claim 1 wherein said at least one gas channel has an axis that intersects said inner surface at a non-zero angle of incidence.

8. The gas valve assembly of claim 1, wherein the body of said first auxiliary regulator comprises a cylindrical cap and a cylindrical body extending from the cap, wherein the recess formed by said conical surface is opposite the cap.

9. The gas valve assembly of claim 8 further comprising a second auxiliary regulator having a cylindrical cap, a cylindrical body extending from the cap, a conical surface forming a recess in the cap opposite the body, and a plurality of surfaces defining a plurality of cylindrical channels through the cap, wherein the conical surface is in contact with the second end of the main regulator.

10. The gas valve assembly of claim 9 further comprising an adjustment screw having a first end, a drivable second end opposite the first end, and a cylindrical surface defining a recess adjacent to the first end, wherein the recess is axially aligned with the body of the second auxiliary regulator.

11. The gas valve assembly of claim 8 wherein the first auxiliary regulator occupies the first opening of the gas chamber.

* * * * *